United States Patent [19]

Walker

[11] Patent Number: 5,046,243

[45] Date of Patent: Sep. 10, 1991

[54] METHOD OF MOUNTING ELECTRICAL CONTACTS IN CONNECTOR BODY

[75] Inventor: Richard P. Walker, Saegertown, Pa.

[73] Assignee: GTE Products Corporation, Stamford, Conn.

[21] Appl. No.: 609,314

[22] Filed: Nov. 5, 1990

[51] Int. Cl.[5] ..... H01R 43/02

[52] U.S. Cl. ..... 29/878; 29/509; 29/611; 361/400

[58] Field of Search ..... 29/509, 878, 611; 361/400

[56] References Cited

U.S. PATENT DOCUMENTS

| | | | |
|---|---|---|---|
| 3,604,110 | 9/1971 | Jerolamon | 29/878 |
| 4,045,653 | 8/1977 | Soper et al. | 29/611 X |
| 4,190,951 | 3/1980 | Armstrong | 29/509 X |
| 4,193,181 | 3/1980 | Boulanger | 29/509 |
| 4,361,862 | 11/1982 | Martyniak | 361/400 X |
| 4,528,750 | 7/1985 | Fink | 29/878 |
| 4,803,779 | 2/1989 | Blatta | 28/878 |
| 4,860,445 | 8/1989 | Jones | 29/842 |
| 4,985,991 | 1/1991 | Finn | 29/878 |

*Primary Examiner*—Carl J. Arbes

*Attorney, Agent, or Firm*—William H. McNeill

[57] ABSTRACT

Electrical contacts are fixed in a connector by ultrasonic melting of a portion of the connector body. The contacts are positioned in appropriate apertures having one part formed with a boss which defines a well. A widened section of the contact fits into the well and the boss is melted and forced into the well, thus fixing the contact in position.

3 Claims, 1 Drawing Sheet

METHOD OF MOUNTING ELECTRICAL CONTACTS IN CONNECTOR BODY

TECHNICAL FIELD

This invention relates to electrical connectors and more particularly to a method of mounting electrical contacts within a thermoplastic connector body.

BACKGROUND ART

Fixing electrical contacts within insulating connectors is often troublesome. Many techniques have been employed, including force fitting, i.e., friction; molding the connector body around the contacts; and by heating the body to melt some of the material around a contact. Friction fitting can damage the contact; insert molding is expensive, and melting by the direct application of heat is cumbersome and time-consuming. Melting of portions of a connector body has also been accomplished by ultrasonic vibration, see, for example, U.S. Pat. No. 4,860,445, wherein contacts were held in position by an alignment plate.

DISCLOSURE OF THE INVENTION

It is, therefore, an object of the invention to obviate the disadvantages of the prior art.

It is another object of the invention to enhance the art of connector making.

Yet another object of the invention is the provision of a method of sealing contacts into a connector body having a thin wall section.

Yet other objects of the invention are to provide a fast, simple, and economical method for fixing electrical contacts into connector bodies.

These objects are accomplished, in one aspect of the invention, by the provision of a method of fixing an electrical contact into a connector body, said electrical contact having a first portion with a first major dimension, a second portion with a second major dimension, and a third portion extending from said second portion in a direction opposite to said first portion; said connector body having an aperture with a first section formed to receive said first portion of said electrical contact and a second section formed to receive said second portion of said contact; a boss surrounding said second section of said aperture and extending above a surface of said connector body whereby said second portion is positioned in a well, the steps comprising: inserting said electrical contact into said aperture with said first portion of said contact in said first section and said second portion in said second section; positioning said contact and connector body at a work station which includes an ultrasonic horn; causing relative movement between said connector body and said horn until said third portion of said contact engages a horn aperture in said horn and a depression surrounding said horn aperture engages said boss; and ultrasonically vibrating said horn to melt said boss and cause said melted material to flow into and substantially fill said well, thereby securing said contact.

This method is extremely fast and reliable and is well suited for mass production and inclusion in an automatic assembly operation.

BEST MODE FOR CARRYING OUT THE INVENTION

For a better understanding of the present invention, together with other and further objects, advantages, and capabilities thereof, reference is made to the following disclosure and appended claims taken in conjunction with the above-described drawings.

Figure 1:
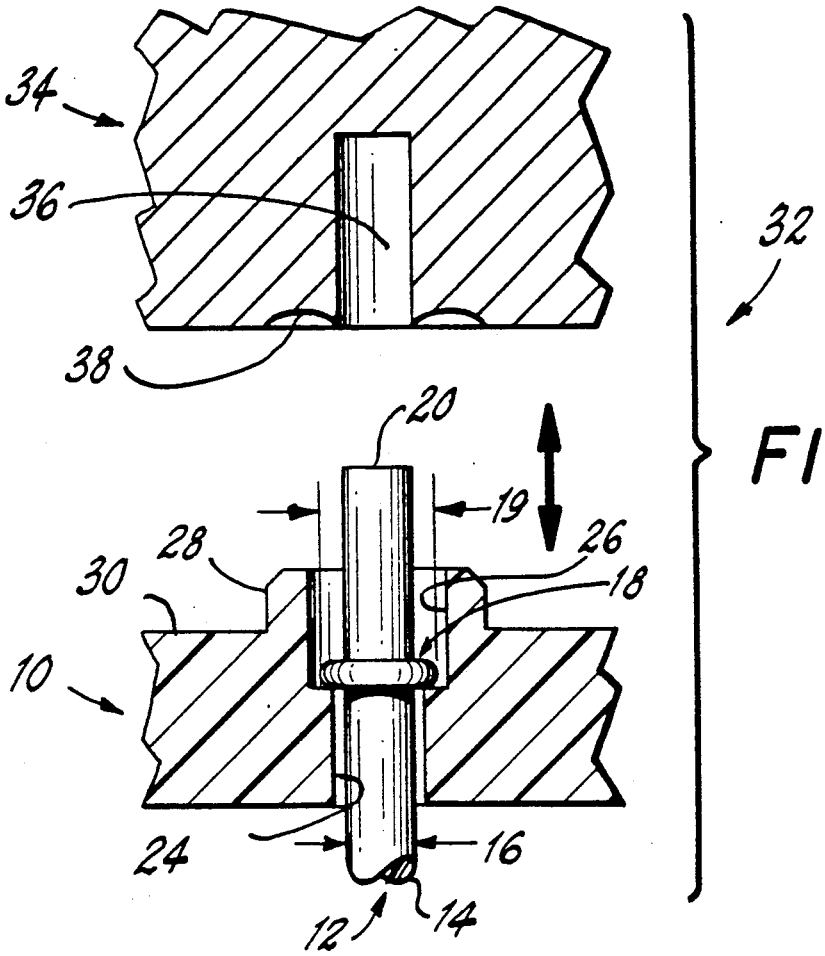
FIG. 1 is an exploded view of a connector and contact at a work station prior to melting.

Referring now to the drawings with greater particularity, there is shown in FIG. 1 a portion of a connector body 10 having therein an electrical contact 12. Contact 12 has a first portion 14 with a first major dimension 16, which can be a diameter, and a second portion 18, with a second major dimension 19, which can also be a diameter, and in any event is larger than the first dimension. A third portion 20 extends from the second portion in a direction opposite to the first portion 14. That is, in this distance, all three portions are aligned along a longitudinal axis 22.

The connector body 10 has an aperture having a first section 24 formed to receive the first portion 14 of the contact 12, and a second section 26 formed to receive the second portion 18 of the contact 12. A boss surrounds the second section 26 and extends above a surface 30 of the connector body, effectively providing a well for the second section.

To seal the contact 12 into the connector body 10, a contact is inserted into the aperture in the connector body. The first portion of the contact enters the first section of the aperture and the second portion of the contact sits in the well formed by the second section 26 and the boss 28.

Figure 2:
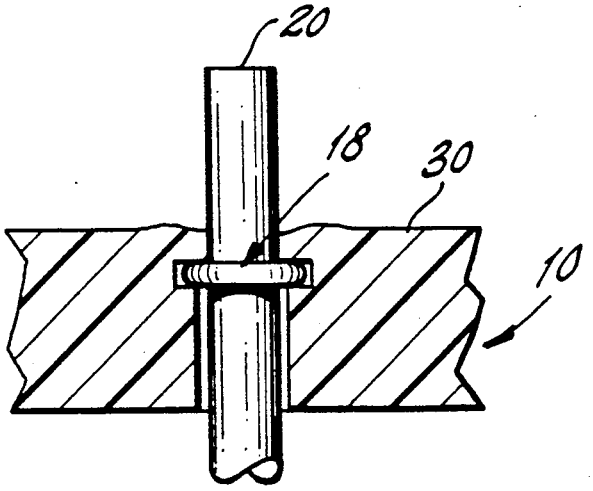
FIG. 2 is a cross-sectional, elevational view of the connector after the contact is fixed in position.

To fix the contact 12 within the connector 10, the connector body is positioned at a work station 32, as shown diagrammatically in FIG. 1. An ultrasonic horn 34 is positioned at the work station and relative movement is caused between them until the third portion 20 of the contact 12 engages an aperture 36 in the horn 34 and a depression 38 which surrounds the horn aperture engages the top of the boss 28. The horn is then ultrasonically vibrated to melt the boss and cause the material to flow into the well, thereby securing the contact, as is shown in FIG. 2.

The horn 34 comprises a steel member which can have tuning slots (not shown) formed therein.

In a preferred embodiment of the invention, the ultrasonic apparatus uses a Dukane 1500 watt, 20,000 pulse thruster with a 0.6 to 1 booster. With such a system vibrating the horn at 20,000 cycles per second, the entire operation takes three seconds. The melting alone is accomplished in about two seconds. During the operation a slight pressure is provided to aid in the flow of the boss 28 into the wall.

There is thus provided a fast, efficient system and method for staking or fixing electrical contacts in a connector body.

The method is ideally suited to contact inclusion wherein the contact must be sealed into a relatively thin section; of the connector body. Due to the geometry involved, as shown in FIGS. 1-3, good pull-out strength and stability are imparted to the assembly.

Additionally, this method provides an effective seal to resist leakage of contaminants along the body of the contact.

Material section for the connector body will depend on many factors, such as final use and strength requirements and a material having appropriate strength for many applications is Valox 508-PBT, which is available from the General Electric Co. However, this material is fiberglass reinforced and, it is noted, the best flow characteristics for ultrasonic welding are derived from materials having no fiberglass therein.

While there have been shown what are at present considered to be the preferred embodiments of the invention, it will be apparent to those skilled in the art that various changes and modifications can be made herein without departing from the scope of the invention as defined by the appended claims.

I claim:

1. In a method of fixing an electrical contact into a connector body, said electrical contact having a first portion with a first major dimension, a second portion with a second major dimension, and a third portion extending from said second portion in a direction opposite to said first portion; said connector body having an aperture with a first section formed to receive said first portion of said electrical contact and a second section formed to receive said second portion of said contact; a boss surrounding said second section of said aperture and extending above a surface of said connector body whereby said second portion is positioned in a well, the steps comprising: inserting said electrical contact into said aperture with said first portion of said contact in said first section and said second portion in said second section; positioning said contact and connector body at a work station which includes an ultrasonic horn; causing relative movement between said connector body and said horn until said third portion of said contact engages a horn aperture in said horn and a depression surrounding said horn aperture engages said boss; and ultrasonically vibrating said horn to melt said boss and cause said melting material to flow into and substantially fill said well, thereby securing said contact.

2. The method of claim 1 wherein said horn vibrates at a frequency of 20,000 cycles per second.

3. The method of claim 2 wherein said horn vibrates for about two seconds.

* * * * *